United States Patent [19]

Fukuzawa

[11] 3,934,546

[45] Jan. 27, 1976

[54] APPARATUS FOR FIXING WITH SOLVENT VAPORS

[75] Inventor: Hideo Fukuzawa, Ebina, Japan

[73] Assignee: Rank Xerox Ltd., London, England

[22] Filed: Dec. 9, 1974

[21] Appl. No.: 531,253

[30] Foreign Application Priority Data

Dec. 25, 1973 Japan ..... 48-147207

[52] U.S. Cl. ..... 118/48; 312/31.01; 427/248

[51] Int. Cl.[2] ..... B05C 19/02

[58] Field of Search ..... 118/48, 49.5; 427/248; 312/31.01, 31.2, 31.3

[56] References Cited

UNITED STATES PATENTS

| | | | |
|---|---|---|---|
| 292,220 | 1/1884 | Smith | 118/48 |
| 366,421 | 7/1887 | Mendenhall | 118/48 |
| 3,028,683 | 4/1962 | Teiser et al. | 118/48 |
| 3,876,410 | 4/1975 | Scholes | 118/48 |

*Primary Examiner*—Mervin Stein
*Assistant Examiner*—Steven Hawkins

[57] ABSTRACT

Apparatus for fixing solvent vapors in electrophotography comprising a housing retained in a horizontal position, a tray located within said housing and movable into and out of said housing through an opening provided at one side thereof, a solvent vaporizing medium located in a horizontal position within said housing and provided with grooves, a plurality of rod members accommodated within each of said grooves of said solvent vaporizing medium, a solvent feeding means located overhead said solvent vaporizing medium for feeding a solvent dropwise to said rod members in said grooves.

3 Claims, 6 Drawing Figures

APPARATUS FOR FIXING WITH SOLVENT VAPORS

BACKGROUND OF THE INVENTION

This invention relates to fixing devices for electrophotographic duplicator machines, and more particularly to a solvent vapor fixing apparatus wherein fixing is effected by the use of a vaporized solvent.

In the fixing device of the nature mentioned above, it has been the usual practice to extend, as shown in FIGS. 1 and 2, a solvent vaporizing medium *e* made of felt with a pendant lower end portion *d* within a slantingly disposed housing *a*, leaving a space for accommodating a tray *c* which carries a fixing paper sheet *b*. A solvent is fed to the solvent vaporizing medium *e* through a solvent replenishing port *f* in the housing *a*, allowing the solvent to impregnate into and vaporize from the solvent vaporizing medium *e* thereby effecting the fixing. The existing fixing devices of such nature have drawbacks in that the solvent cannot be soaked into the solvent vaporizing medium 4 in a satisfactorily sufficient amount and that the solvent which has a relatively large specific gravity tends to accummulate at the lower end of the housing *a*, with the result that it becomes difficult to effect the fixing in an uniform manner and the solvent vapor is allowed to escape from the housing every time the tray is inserted into or drawn out of the duplicator machine.

SUMMARY OF THE INVENTION

The present invention has as its object the elimination of the aforementioned drawbacks inherent to the conventional devices, by providing a solvent vapor fixing device comprising a housing retained in a horizontal position, a tray located within the housing and movable into and out of the housing through an opening provided at one side thereof, a solvent vaporizing medium located in a horizontal position within the housing and provided with a groove, a plurality of rod members accomodated within the groove of the solvent vaporizing medium, and a solvent feeding means located over the solvent vaporizing medium for feeding a solvent dropwise to the rod members through a suitable means such as a pipe, thereby uniformly dispersing and infiltrating the solvent into the solvent vaporizing medium.

BRIEF DESCRIPTION OF THE VIEWS

DESCRIPTION OF THE PREFERRED EMBODIMENT

Figure 1:
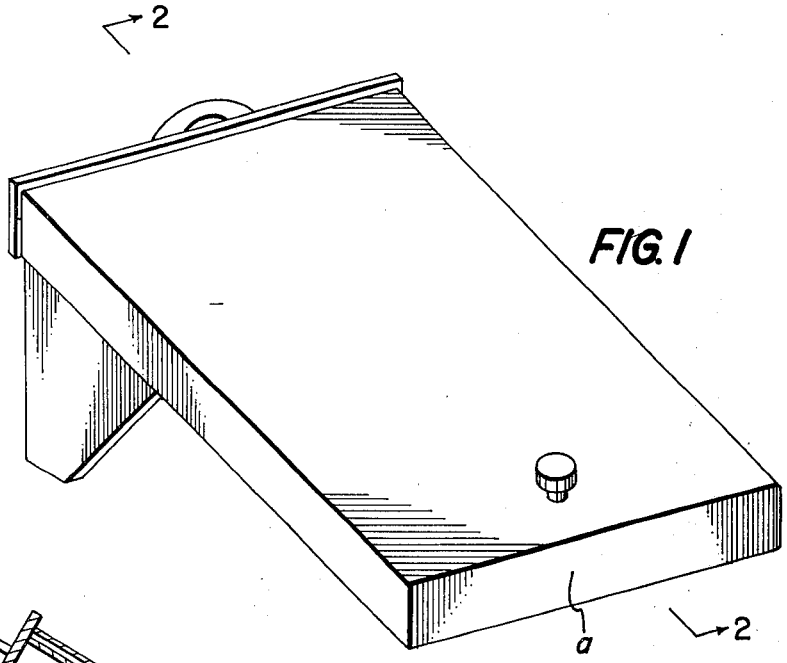
FIG. 1 is a perspective view showing a conventional solvent vapor fixing device.
Figure 2:
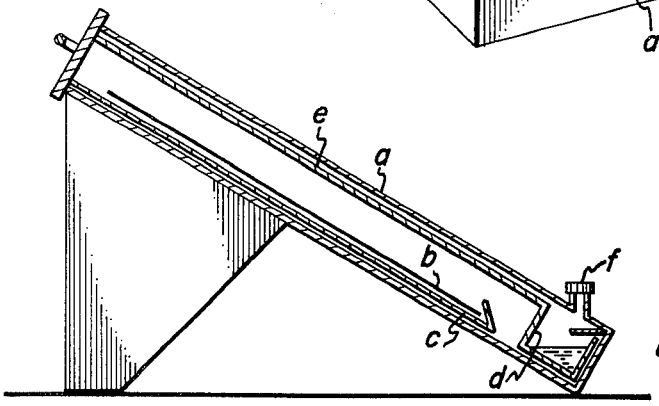
FIG. 2 is a cross-sectional view taken along line II—II of FIG. 1.
Figure 3:
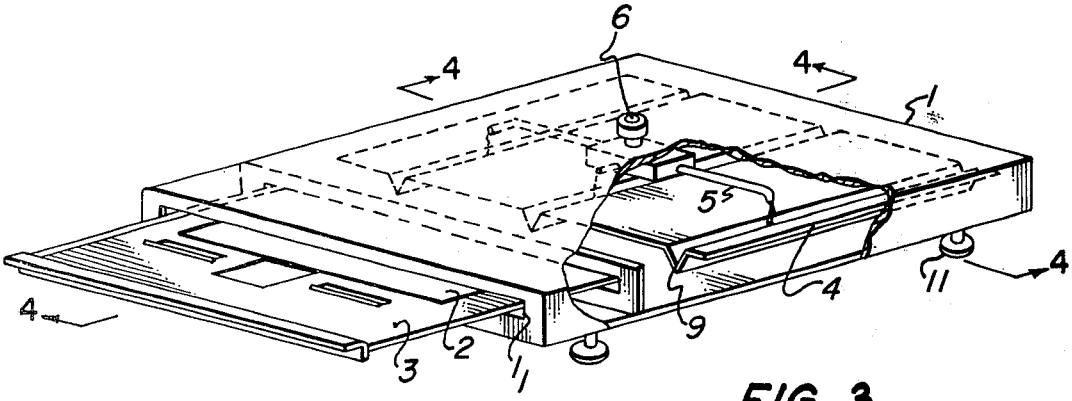
FIG. 3 is a perspective view showing the general construction of the solvent fixing device of the invention.

The present invention will now be described more specifically with reference to FIGS. 3 through 6. There is indicated at 1 a housing which accommodates a tray 3 for carrying a fixing paper sheet 2, a solvent vaporizing medium 4 such as of felt which is located in a position above the tray 3 and a dispenser 5 which is located in a position over the solvent vaporizing medium 4 and held in communication with a solvent replenishing port 6 positioned outside the housing 1.

The above-mentioned tray 3 is supported on support guide rollers 7 which are supported at opposite ends thereof on the housing 1 and may be inserted into or drawn out of the housing 1 through an opening $1_1$ provided at one side thereof.

Figure 4:
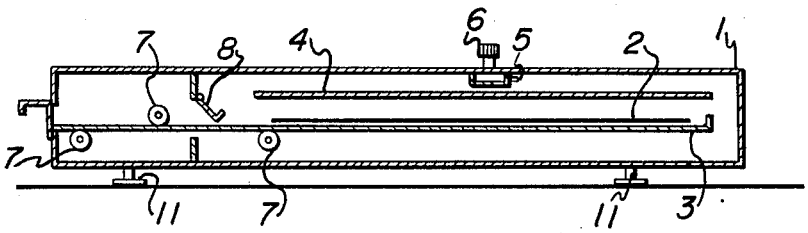
FIG. 4 is a cross-sectional view taken along line IV—IV of FIG. 3.
Figure 5:
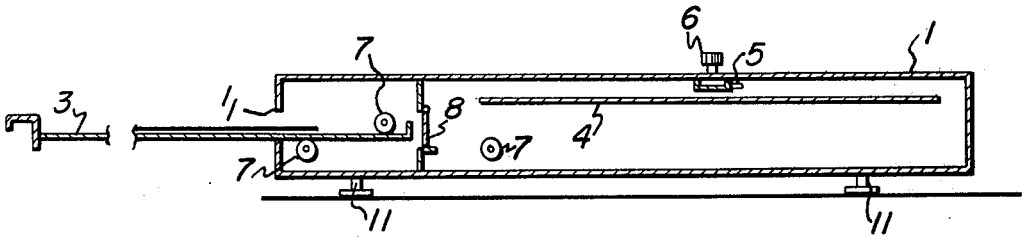
FIG. 5 is a cross-sectional view taken along line V—V of FIG. 3 showing a tray in a drawn-out position.

A movable shutter 8 is provided in the passage of the tray 3 at a position adjacent to the opening $1_1$ of the housing 1. The shutter 8 is held in an open position when the tray 3 is inserted within the housing 1 as shown in FIG. 4. However, as shown in FIG. 5, when the tray 3 is drawn out of the housing 1, the shutter 8 is held in a closed position to shield the interior of the housing 1 from the outside.

The solvent vaporizing medium 4 mentioned hereinabove is provided with a plurality of grooves 9 and supported at opposite ends by the housing 1 to extend horizontally within the inner space of the housing 1, each of the grooves 9 accommodating therein a plurality of rod members 10.

The dispenser 5 mentioned above serves to distribute the solvent which has been supplied in a predetermined amount from the solvent feeding port 6 and is adapted to feed the solvent dropwise onto the plural number of rod members 10 within the grooves 9.

The reference numeral 11 indicates leg members for supporting the housing 1.

Figure 6:
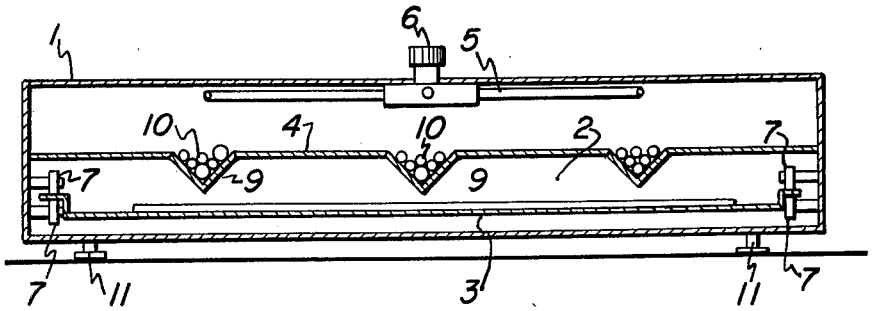
FIG. 6 is a cross-sectional view taken along line VI—VI of FIG. 3.

With the above construction, a predetermined amount of solvent is fed through the solvent feeding port 6 of the housing 1 which is held in a horizontal position. Thus, the fed solvent is distributed by the dispenser 5 dropwise onto the respective rod members 10 as shown in FIG. 6, allowing the solvent to flow and disperse over the surfaces of the rod members 10 for impregnating with the solvent the entire area of the solvent vaporizing medium 4 which is extended horizontally within the housing 1.

On the contrary, for example, if the solvent is dropped directly onto the solvent vaporizing medium 4 from the dispenser 5, the speed of impregnation of the solvent is lower as compared with the amount of the supplied solvent so that the portions of the solvent vaporizing medium 4 on which the solvent is dropped becomes saturated with the result that the solvent is allowed to flow over the solvent vaporizing medium without being soaked into the entire area of the solvent vaporizing medium. However, on the other hand, if the predetermined amount of solvent from the dispenser 5 is dropped onto the rod members 10 in the manner as described hereinbefore, the solvent is fed to the solvent vaporizing medium giving uniform fixing effects on the fixing paper sheet 2.

In summary, the solvent vapor fixing device according to the present invention is particularly suitable for use in electrophotographic duplicator machines and comprises a housing 1 retained in a horizontal position, a tray 3 located within the housing 1 and movable into and out of the housing 1 through an opening provided at one side thereof, a solvent vaporizing medium 4 located in a horizontal position within the housing 1 and provided with grooves 9, a plurality of rod members accommodated within the grooves 9 of the solvent vaporizing medium 4, and a solvent feeding means located in a position over the solvent vaporizing medium for feeding dropwise a solvent onto the rod members 10 in the grooves 9. With this fixing device construction, the solvent dropped from the solvent feeding means flows along the surfaces of the rod members 10 in the grooves 9 and uniformly dispersed and impregnates into the entire area of the solvent vaporizing medium 4 to ensure uniform vaporization thereof. Thus, it becomes possible to carry out uniform fixing of the fixing paper sheet on the tray 3.

What is claimed is:

1. Fixing apparatus comprising:

a housing having an opening in one side therein and retained in a horizontal position, a tray located within said housing and movable into and out of said opening, a solvent vaporizing medium located in a horizontal position in said housing, said medium being formed with at least one groove, a plurality of rod members within said groove, and solvent feeding means located above said medium for feeding solvent onto said rod members.

2. The combination recited in claim 1 wherein said feeding means comprises means for feeding said solvent in drops onto said rods.

3. The combination recited in claim 2 wherein said medium comprises a plurality of grooves.

* * * * *